US009153159B2

(12) United States Patent
Suh et al.

(10) Patent No.: US 9,153,159 B2
(45) Date of Patent: Oct. 6, 2015

(54) DISPLAY DRIVING CIRCUIT AND ELECTRONIC DEVICE COMPRISING THE SAME

(71) Applicant: SAMSUNG ELECTRONICS CO., LTD., Suwon-si, Gyeonggi-do (KR)

(72) Inventors: DongWook Suh, Bucheon-si (KR); Sooyoung Woo, Suwon-si (KR); Ji Haeng Lee, Seoul (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 168 days.

(21) Appl. No.: 13/940,360

(22) Filed: Jul. 12, 2013

(65) Prior Publication Data

US 2014/0015823 A1 Jan. 16, 2014

(30) Foreign Application Priority Data

Jul. 12, 2012 (KR) ..... 10-2012-0076198

(51) Int. Cl.

| | |
|---|---|
| ***G09G 3/20*** | (2006.01) |
| ***G09G 5/00*** | (2006.01) |
| ***G09G 3/32*** | (2006.01) |
| ***G09G 3/36*** | (2006.01) |

(52) U.S. Cl.

CPC ..... *G09G 3/20* (2013.01); *G09G 3/3275* (2013.01); *G09G 3/3677* (2013.01); *G09G 5/001* (2013.01); *G09G 2330/022* (2013.01); *G09G 2360/12* (2013.01)

(58) Field of Classification Search

CPC ..... G06G 2330/00–2330/022; G06G 5/01
USPC ..... 345/211–213
See application file for complete search history.

(56) References Cited

U.S. PATENT DOCUMENTS

| | | | | |
|---|---|---|---|---|
| 5,327,172 | A | 7/1994 | Tan et al. | |
| 7,379,058 | B2 | 5/2008 | Toyozawa et al. | |
| 2006/0262059 | A1 * | 11/2006 | Hashimoto et al. | 345/89 |
| 2007/0159006 | A1 | 7/2007 | Lee et al. | |
| 2011/0141089 | A1 | 6/2011 | Lee | |
| 2011/0187698 | A1 * | 8/2011 | Jung | 345/212 |
| 2011/0292024 | A1 | 12/2011 | Baek et al. | |

FOREIGN PATENT DOCUMENTS

| | | |
|---|---|---|
| JP | 2000163023 | 6/2000 |
| JP | 2002207457 | 7/2002 |
| JP | 2004226787 | 8/2004 |
| KR | 20000041551 | 7/2000 |
| KR | 20020009295 | 2/2002 |

(Continued)

*Primary Examiner* — Seokyun Moon
*Assistant Examiner* — David Tung
(74) *Attorney, Agent, or Firm* — F. Chau & Associates, LLC

(57) ABSTRACT

A display driver integrated circuit includes a regulator configured to convert an externally supplied driving voltage to a working voltage corresponding to one of a plurality of power domains of the display driver integrated circuit, a graphic data processing unit configured to process image data input to the graphic data processing unit, and output the image data to a display panel, a control switch configured to control a supply of the working voltage to the graphic data processing unit, and a core logic unit configured to receive the working voltage from the regulator and control the control switch in response to a mode of operation of the display driver integrated circuit.

17 Claims, 7 Drawing Sheets

(56) References Cited

FOREIGN PATENT DOCUMENTS

| | | |
|---|---|---|
| KR | 20030021947 | 3/2003 |
| KR | 20080024321 | 3/2008 |
| KR | 20100082527 | 7/2010 |
| KR | 20110010212 | 2/2011 |

* cited by examiner

DISPLAY DRIVING CIRCUIT AND ELECTRONIC DEVICE COMPRISING THE SAME

CROSS-REFERENCE TO RELATED APPLICATIONS

This application claims priority under 35 U.S.C. §119 to Korean Patent Application No. 10-2012-0076198, filed on Jul. 12, 2012, the disclosure of which is incorporated by reference herein in its entirety.

TECHNICAL FIELD

Exemplary embodiments of the inventive concept relate to a display driving circuit and an electronic device including the same, and more particularly, to a display driving circuit capable of reducing a leakage current in a standby mode of operation and an electronic device including the same.

DISCUSSION OF THE RELATED ART

A display device is a device which visually outputs image data. As the size, resolution and brightness of display devices increase, the power consumption of display devices may also increase. Further, the size of function blocks in a display driving circuit of the display device used to process image data may also increase. For example, the area of a display driving circuit occupied by a shift register and a latch circuit may increase. As the size of the shift register and the latch circuit is decreased in an effort to reduce the area of the display driving circuit occupied by the shift register and the latch circuit, a leakage current may increase. For example, a leakage current may increase in a standby mode of the display device in which no image data is output to a display panel of the display device. An increase in the leakage current produced in the standby mode of the display device may affect the power consumption of a mobile display device which uses a battery as a power supply.

SUMMARY

Exemplary embodiments of the present inventive concept provide a display driver integrated circuit which has multiple power domains. The display driver integrated circuit includes a regulator configured to convert an externally supplied driving voltage into a working voltage corresponding to one of the multiple power domains, a graphic data processing unit configured to process input image data to be output to a display panel, a first control switch configured to control a supply of the working voltage to the graphic data processing unit, and core logic configured to receive the working voltage from the regulator and control the control switch in response to a mode of operation.

In an exemplary embodiment, when the mode of operation is a display mode, the first control switch is closed such that the working voltage is supplied to the graphic data processing unit.

In an exemplary embodiment, when the mode of operation is a standby mode, the first control switch is opened such that the working voltage to be supplied to the graphic data processing unit is blocked.

In an exemplary embodiment, the graphic data processing unit includes a shift register configured to sequentially shift and store input image data, and a latch circuit configured to latch the image data output from the shift register.

In an exemplary embodiment, the shift register and the latch circuit operate in a first power domain, using a lowest voltage, from among the multiple power domains.

In an exemplary embodiment, the graphic data processing unit further includes a D/A converter configured to receive the image data from the latch circuit and generate a voltage for outputting the image data to a display panel.

In an exemplary embodiment, the D/A converter operates in a second power domain using a voltage higher than a voltage used in the first power domain.

In an exemplary embodiment, the display driver integrated circuit further includes a memory configured to store the image data, and a second control switch configured to control a supply of the working voltage to the memory.

In an exemplary embodiment, the memory operates in a first power domain, using a lowest voltage, from among the multiple power domains.

In an exemplary embodiment, when the mode of operation is a standby mode, the first control switch is opened such that the working voltage is blocked.

In an exemplary embodiment, the core logic unit controls the second control switch to be closed regardless of a mode of operation of the display driver integrated circuit.

In an exemplary embodiment, the memory is a volatile memory.

Exemplary embodiments of the inventive concept provide an electronic device which includes a display module configured to output image data via a display panel, a processor configured to control an overall operation of the display module, and a battery configured to supply power to the processor and the display module. The display module includes a source driver integrated circuit configured to process the image data to be output to the display panel. When the display module operates in a standby mode in which the image data is not output to the display panel, the source driver integrated circuit blocks a supply of a voltage used to process the image data to be output to the display panel.

In an exemplary embodiment, the source driver integrated circuit includes a graphic data processing unit configured to process the image data to be output to the display panel, a control switch configured to control a supply of the working voltage to the graphic data processing unit, and a core logic unit configured to control the control switch.

In an exemplary embodiment, when the display module operates in a display mode in which the image data is output to the display panel, the core logic closes the control switch.

Exemplary embodiments of the inventive concept provide a display driver integrated circuit including a regulator configured to convert an externally supplied driving voltage to a working voltage corresponding to one of a plurality of power domains of the display driver integrated circuit, a graphic data processing unit configured to process image data input to the graphic data processing unit, and output the image data to a display panel, a first control switch configured to control a supply of the working voltage to the graphic data processing unit, and a core logic unit configured to receive the working voltage from the regulator and control the first control switch in response to a mode of operation of the display driver integrated circuit.

Exemplary embodiments of the inventive concept provide a method of driving a display device including converting an externally supplied driving voltage to a working voltage corresponding to one of a plurality of power domains of a display driver integrated circuit, processing image data in a graphic data processing unit of the display driver integrated circuit, and controlling a supply of the working voltage to the graphic data processing unit. The working voltage is supplied to the graphic data processing unit or blocked from the graphic data processing unit based on a mode of operation of the display driver integrated circuit.

In an exemplary embodiment, the method further includes closing a switch operatively coupled to the graphic data processing unit while the mode of operation is a display mode, wherein the working voltage is supplied to the graphic data processing unit in the display mode.

In an exemplary embodiment, the method further includes opening a switch operatively coupled to the graphic data processing unit while the mode of operation is a standby mode, wherein the working voltage is blocked from the graphic data processing unit in the standby mode.

In an exemplary embodiment, the graphic data processing unit includes a shift register sequentially shifting and storing the image data and outputting the image data, and a latch circuit latching the image data output from the shift register. The shift register and the latch circuit operate in a first power domain from among the plurality of power domains, and the first power domain has a lowest voltage of the plurality of power domains.

In an exemplary embodiment, the graphic data processing unit further includes a digital-to-analog (D/A) converter receiving the image data from the latch circuit and generating a voltage for outputting the image data to a display panel. The D/A converter operates in a second power domain using a voltage higher than the lowest voltage used in the first power domain.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION

Figure 1:
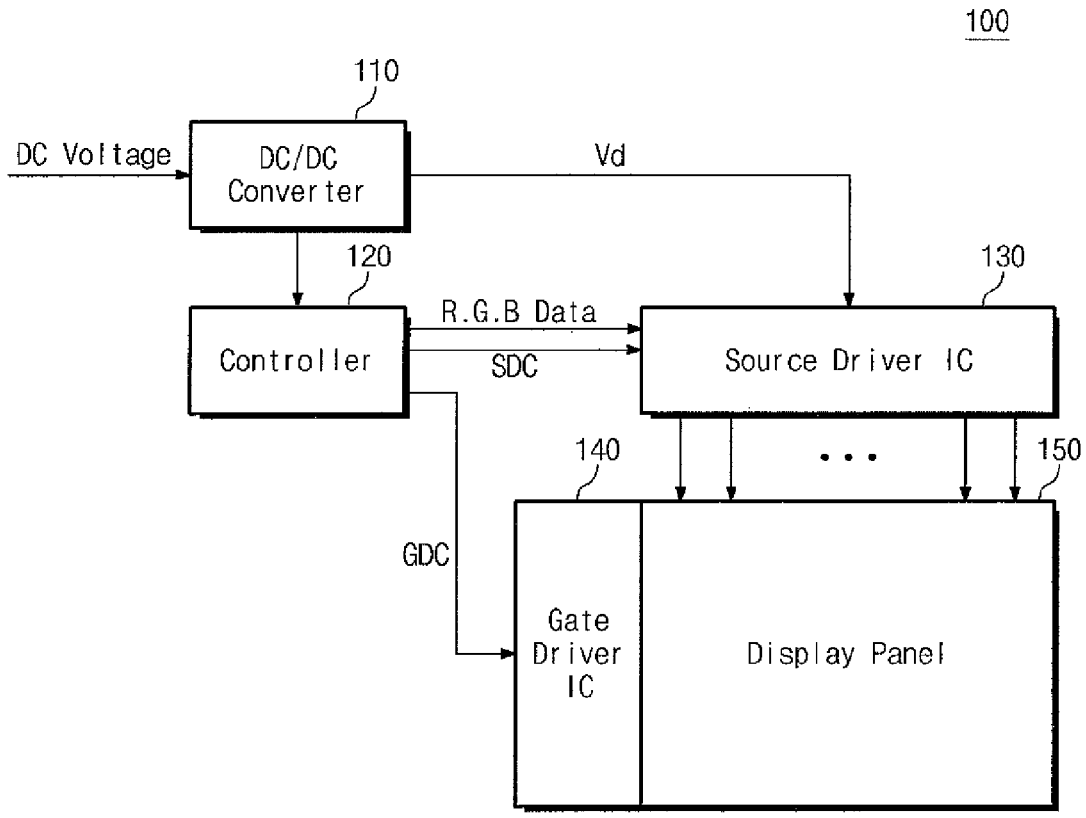
FIG. 1 is a block diagram illustrating a display device, according to an exemplary embodiment of the inventive concept.

Exemplary embodiments of the present inventive concept will be more fully described hereinafter with reference to the accompanying drawings. Like reference numerals may refer to like elements throughout the accompanying drawings.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. In addition, it will also be understood that when an element is referred to as being "between" two elements, it can be the only element between the two elements, or one or more intervening elements may also be present.

It will be understood that when an element or layer is referred to as being "on", "connected to", "coupled to", or "adjacent to" another element or layer, it can be directly on, connected, coupled, or adjacent to the other element or layer, or intervening elements or layers may be present.

FIG. 1 is a block diagram illustrating a display device, according to an exemplary embodiment of the inventive concept.

Referring to FIG. 1, a display device 100 according to an exemplary embodiment of the inventive concept may include a DC-to-DC (DC/DC) converter 110, a controller 120, a source driver circuit integrated circuit (IC) 130, a gate driver integrated circuit (IC) 140, and a display panel 150.

The DC/DC converter 110 converts a DC voltage provided from a power supply into a driving voltage Vd for driving the display panel 150. The DC/DC converter 110 supplies the driving voltage Vd to the controller 120 and the source driver IC 130.

The controller 120 provides the source driver IC 130 and the gate driver IC 140 with a data signal and a timing signal for controlling an output of the display panel 150. For example, the controller 120 may receive red (R), green (G), and blue (B) image data, a horizontal synchronization signal Vsync, a horizontal synchronization signal Hsync, a main clock MCLK, a data enable signal DE, etc., from a graphic controller, and may generate source and gate control signals SDC and GDC based on the received input signals. For example, operation of the source driver IC 130 may be based on the source control signal SDC provided from the controller 120, and operation of the gate driver IC 140 may be based on the gate control signal GDC.

The source driver IC 130 is driven by the driving voltage Vd, which is received from the DC/DC converter 110. The source driver IC 130 may have multiple power domains. For example, function blocks of the source driver IC 130 may be driven at different power domains. Thus, the internal function blocks of the source driver IC 130 may be driven by different voltages, respectively. In exemplary embodiments, the source driver IC 130 may convert the driving voltage Vd into a working voltage corresponding to one of the multiple power domains, and may use the working voltage. Herein, the working voltage may refer to a voltage used for driving an internal function block(s) of the source driver IC 130. That is, internal function blocks of the source driver IC 130 may be driven using converted working voltage(s).

The source driver IC 130 may generate voltages corresponding to R, G, and B image data transferred from the controller 120 in response to the source control signal SDC. The voltages may be supplied to the display panel 150. The above-described operation of the source driver IC 130 may be understood to be an operation corresponding to a display mode of the display device 100. Alternatively, when the above-described operation is not performed by the source driver IC 130, it may be understood to be an operation corresponding to a standby mode of the display device 100. That is, the source driver IC 130 may operate in a display mode and a standby mode.

While in the display mode, the source driver IC 130 may operate using a working voltage, which is generated based on the driving voltage Vd provided from the DC/DC converter 110, as described above. Alternatively, while in the standby mode, the source driver IC 130 may block a voltage to be supplied to internal components of the source driver IC 130 which process the R, G, and B image data to be output to the display panel 150. The voltage to be supplied to the internal components may be blocked while in the standby mode since operation of the internal components may not be needed while in the standby mode. As a result, the source driver IC 130 may reduce a leakage current while in the standby mode.

The gate driver IC 140 may sequentially supply a pulse signal to gate lines of the display panel 150 in response to the gate control signal GDC.

The display panel 150 may output the R, G, and B image data in response to operations of the source driver IC 130 and the gate driver IC 140. The display panel 150 may be, for example, an LCD panel or an OLED panel.

As described above, the source driver IC 130 of the display device 100 may reduce a leakage current occurring while in a standby mode. As a result, the power consumed by the display device 100 may be reduced while reducing or eliminating the negative effects of a leakage current, as described further with reference to FIGS. 2 to 8.

Figure 2:
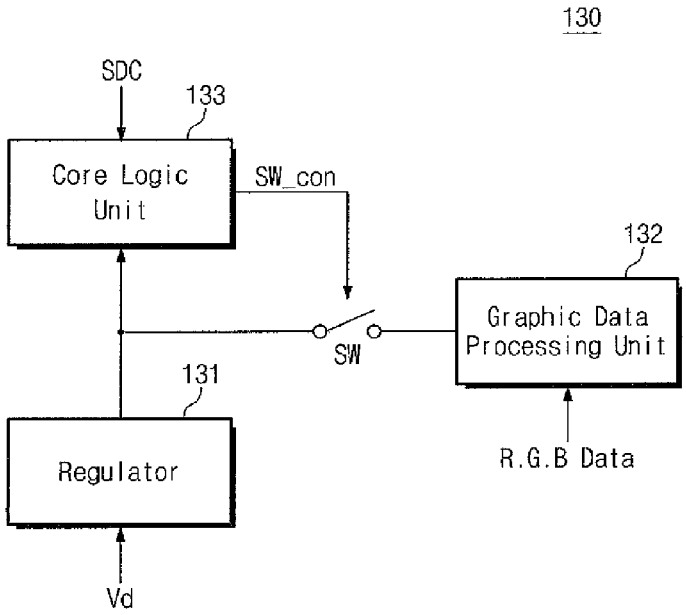
FIG. 2 is a block diagram illustrating a source driver IC, according to an exemplary embodiment of the inventive concept.

FIG. 2 is a block diagram illustrating a source driver IC, according to an exemplary embodiment of the inventive concept.

Referring to FIG. 2, a source driver IC 130 according to an exemplary embodiment of the inventive concept includes a regulator 131, a graphic data processing unit 132, a core logic unit 133, and a control switch SW.

The regulator 131 may convert a driving voltage Vd supplied from an external device (e.g., the DC/DC converter 110, as shown in FIG. 1) into a working voltage. Herein, the working voltage may refer to a voltage used for driving the graphic data processing unit 132 of the source driver IC 130.

The regulator 131 may convert a driving voltage Vd supplied from an external device (e.g., the DC/DC converter 110, as shown in FIG. 1) into a working voltage corresponding to one of multiple power domains of the source driver IC 130.

For example, when the source driver IC 130 operates in a first power domain, the regulator 131 may generate a working voltage (e.g., about 0V to about 1.5V or about 2V) corresponding to the first power domain. When the source driver IC 130 operates in a second power domain, the regulator 131 may generate a working voltage (e.g., about 2V to about 5V or about 6V) corresponding to the second power domain. When the source driver IC 130 operates in a third power domain, the regulator 131 may generate a working voltage (e.g., about 6V to about 18V) corresponding to the third power domain. Herein, a working voltage corresponding to the third power domain may be higher than a working voltage corresponding to the second power domain.

In an exemplary embodiment, the regulator 131 may refer to a single regulator 131 capable of generating working voltages respectively corresponding to multiple power domains. In an exemplary embodiment, the source driver IC 130 may include a plurality of regulators, each generating a different working voltage for different power domains among a plurality of power domains. For example, the single regulator 131 may be replaced with a first regulator that generates a working voltage corresponding to the first power domain, and a second regulator that generates a working voltage corresponding to the second power domain.

The graphic data processing unit 132 may process input R, G, and B image data, and may output the input R, G, and B image data to the display panel 150. For example, when the source driver IC 130 operates in a display mode, the graphic data processing unit 132 may generate gray voltages corresponding to the input R, G, and B image data, and may supply the gray voltages to the display panel 150. In an exemplary embodiment, the R, G, and B image data may be transferred to the graphic data processing unit 132 through the core logic unit 133. However, exemplary embodiments of the inventive concept are not limited thereto.

In exemplary embodiments, the graphic data processing unit 132 of FIG. 2 may be a shift register and latch circuit, as described with reference to FIGS. 4, 6 and 9. The shift register and latch circuit may include a shift register that sequentially shifts and stores input image data, and a latch circuit that latches the image data output from the shift register.

The graphic data processing unit 132 may include a shift register and a latch circuit which operate in the first power domain of the source driver IC 130. In this case, the regulator 131 may convert the driving voltage Vd into a working voltage corresponding to the first power domain, and may supply the working voltage corresponding to the first power domain to the graphic data processing unit 132. The graphic data processing unit 132 may include a digital-to-analog (D/A) converter which operates in the second power domain of the source driver IC 130. In this case, the regulator 131 may convert the driving voltage Vd into a working voltage corresponding to the second power domain, and may supply the working voltage corresponding to the second power domain to the graphic data processing unit 132.

The control switch SW may control the supplying of a working voltage to the graphic data processing unit 132. The control switch SW may be disposed between the regulator 131 and the graphic data processing unit 132, as shown in FIG. 2. The control switch SW may control the supplying of a working voltage to the graphic data processing unit 132 in response to the mode of operation of the source driver IC 130. For example, when the source driver IC 130 operates in a display mode, the control switch SW may be closed such that a working voltage is supplied to the graphic data processing unit 132. Alternatively, when the source driver IC 130 operates in a standby mode, the control switch SW may be opened such that a working voltage to be supplied to the graphic data processing unit 132 is blocked and is not supplied to the graphic data processing unit 132.

The core logic unit 133 may receive a working voltage transferred from the regulator 131, operate responsive to a source control signal SDC, and determine a mode of operation of the source driver IC 130. The core logic unit 133 may control the control switch SW according to a mode of operation of the source driver IC 130. For example, when the source driver IC 130 operates in the display mode, the core logic unit 133 may close the control switch SW using a control signal SW_con. When the source driver IC 130 operates in the standby mode, the core logic unit 133 may open the control switch SW using the control signal SW_con. The core logic unit 133 may include, for example, a CPU.

As described above, the source driver IC 130 may control a working voltage to be supplied to the graphic data processing unit 132, which operates in multiple power domains, according to a current mode of operation. For example, when the source driver IC 130 operates in a standby mode, a working voltage to be supplied to the graphic data processing unit 132 may be blocked and may not be supplied to the graphic data processing unit 132, which may result in a leakage current being reduced, and may further result in the power consumption during a standby mode of a display device 100 being reduced.

Figure 3:
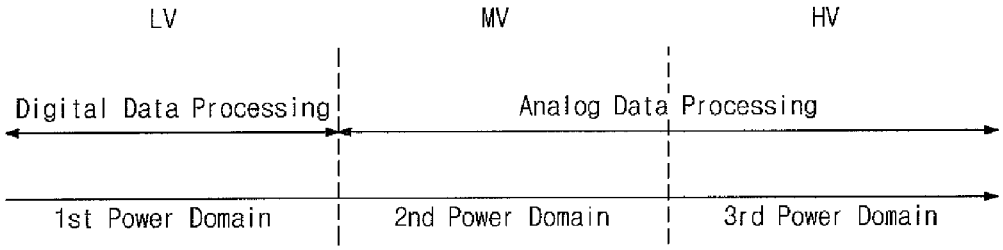
FIG. 3 is a diagram illustrating a power domain according to a level of an operating voltage of a source driver IC, according to an exemplary embodiment of the inventive concept.

FIG. 3 is a diagram illustrating a power domain according to a level of an operating voltage of a source driver IC, according to an exemplary embodiment of the inventive concept.

Referring to FIG. 3, a source driver IC 130 according to an exemplary embodiment of the inventive concept may have multiple power domains. For example, the source driver IC 130 may have a first power domain, a second power domain, and a third power domain.

The source driver IC 130 may be configured to compute and process a digital signal (e.g., image data) using a working voltage corresponding to the first power domain. For example, the source driver IC 130 may drive a shift register and a latch circuit using a working voltage (e.g., about 0V to about 1.5V or about 2V) corresponding to the first power domain. The first power domain may be referred to as a low voltage domain, and is further described with reference to FIG. 4.

The source driver IC 130 may be configured to compute and process an analog signal (e.g., analog voltage) using a working voltage corresponding to the second and third power domains. For example, the source driver IC 130 may drive a D/A converter using a working voltage (e.g., about 2V to about 5V or about 6V) corresponding to the second power domain. The second power domain may be referred to as a medium voltage domain. Further, the source driver IC 130 may drive a display panel 150 using a working voltage (e.g., about 6V to about 18V) corresponding to the third power domain. The third power domain may be referred to as a high voltage domain.

According to exemplary embodiments of the inventive concept, the source driver IC 130 may allow for the reduction of power consumption by driving internal function blocks using different power domains. Thus, unnecessary power consumption may be reduced or eliminated.

Figure 4:
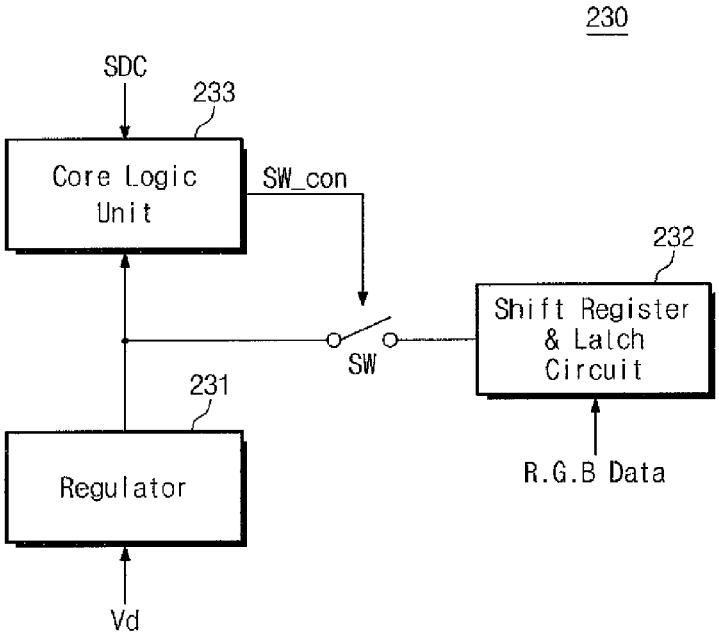
FIG. 4 is a block diagram illustrating a source driver IC, according to an exemplary embodiment of the inventive concept.

FIG. 4 is a block diagram illustrating a source driver IC, according to an exemplary embodiment of the inventive concept. FIG. 4 illustrates an exemplary case in which a source driver IC 230 operates in a first power domain.

Referring to FIG. 4, a source driver IC 230 according to an exemplary embodiment of the inventive concept includes a regulator 231, a shift register and latch circuit 232, a core logic unit 233, and a control switch SW.

The regulator 231 may convert a driving voltage Vd supplied from an external device (e.g., a DC/DC converter) into a working voltage corresponding to a first power domain. Herein, the working voltage may be about 0V to about 1.5V to about 2V.

The shift register and latch circuit 232 may operate using a working voltage supplied from the regulator 231. That is, the shift register and latch circuit 232 may operate based on a working voltage corresponding to the first power domain. The shift register and latch circuit 232 may sequentially shift and store R, G, and B image data so as to be latched at a latch circuit by the horizontal line. According to exemplary embodiments, the source driver IC 230 may be configured such that R, G, and B image data are transferred to the shift register and latch circuit 232 through the core logic unit 233. However, exemplary embodiments of the inventive concept are not limited thereto.

The control switch SW may control the supplying of the working voltage, which corresponds to the first power domain, to the shift register and latch circuit 232. The control switch SW may be disposed between the regulator 231 and the shift register and latch circuit 232, as shown in FIG. 4. The control switch SW may be, for example, a PMOS transistor or an NMOS transistor. However, exemplary embodiments of the inventive concept are not limited thereto.

The core logic unit 233 may receive a working voltage transmitted by the regulator 231, and may operate responsive to a source control signal SDC transmitted by a controller 120 (see, for example, FIG. 1). The core logic unit 233 may determine a mode of operation of the source driver IC 230. The core logic unit 233 may control the control switch SW according to a mode of operation of the source driver IC 230. For example, when the source driver IC 230 operates in the display mode, the core logic unit 233 may close the control switch SW using a control signal SW_con. When the source driver IC 230 operates in the standby mode, the core logic unit 233 may open the control switch SW using the control signal SW_con. The core logic unit 233 may include, for example, a CPU. According to exemplary embodiments, a voltage to be supplied to the shift register and latch circuit 232 operating in the first power domain (e.g., a low voltage domain) may be controlled independently.

As described above, the source driver IC 230 may control a working voltage to be supplied to the shift register and latch circuit 232, which operates in the first power domain (e.g., a low voltage domain), according to a current mode of operation. For example, when the source driver IC 230 operates in a standby mode, a working voltage to be supplied to the shift register and latch circuit 232 may be blocked and may not be supplied to the shift register and latch circuit 232, which may result in a leakage current of the low voltage domain being reduced.

Figure 5:
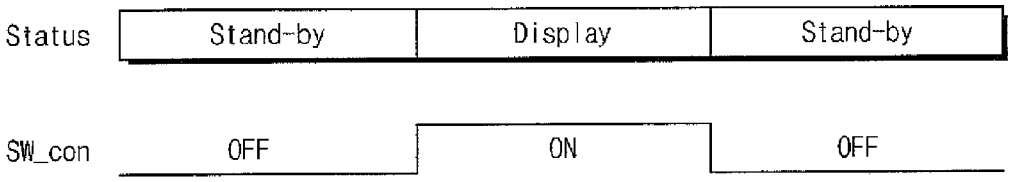
FIG. 5 is a diagram illustrating an operation of a control switch in FIG. 4, according to an exemplary embodiment of the inventive concept.

FIG. 5 is a diagram illustrating an operation of a control switch in FIG. 4, according to an exemplary embodiment of the inventive concept.

Referring to FIG. 5, the core logic unit 233 of the source driver IC 230 may provide a control switch SW with a control signal SW_con for controlling the control switch SW (see, for example, FIG. 4). For example, the core logic unit 233 may determine a mode of operation of the source driver IC 230, and may transmit the control signal SW_con corresponding to the determined mode of operation to the control switch SW.

For example, as shown in FIG. 5, when the source driver IC 230 operates in a standby mode, the core logic unit 233 may transmit the control signal SW_con having a low logic level to the control switch SW. In this case, the control switch SW may be opened such that a working voltage to be supplied to the shift register and latch circuit 232 is blocked and is not transmitted to the shift register and latch circuit 232. When the source driver IC 230 operates in a display mode, the core logic unit 233 may transmit the control signal SW_con having a high logic level to the control switch SW. In this case, the control switch SW may be closed such that a working voltage is supplied to the shift register and latch circuit 232.

Figure 6:
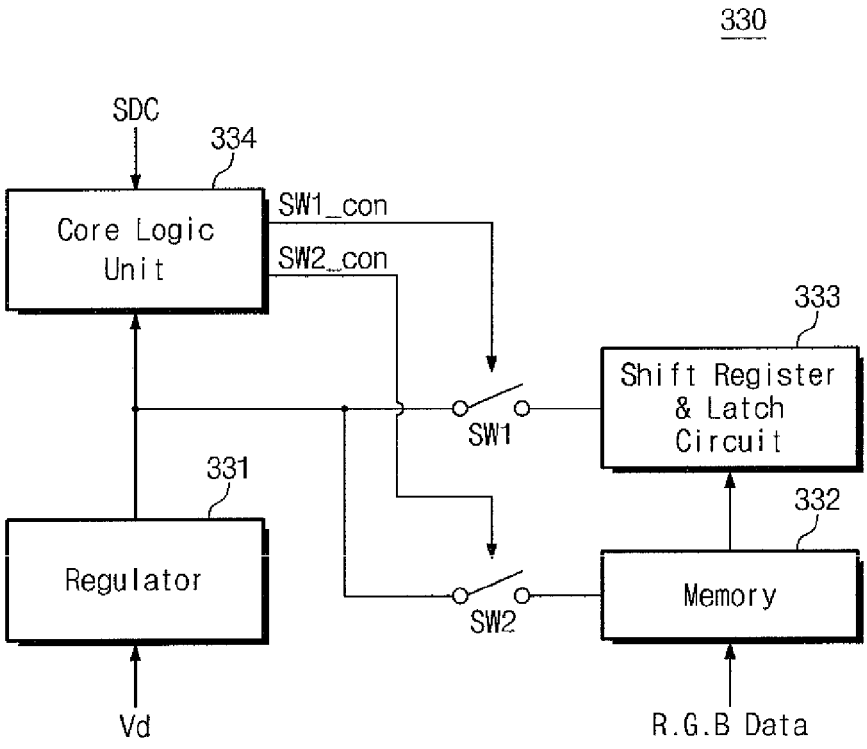
FIG. 6 is a block diagram illustrating a source driver IC, according to an exemplary embodiment of the inventive concept.

FIG. 6 is a block diagram illustrating a source driver IC, according to an exemplary embodiment of the inventive concept.

Referring to FIG. 6, a source driver IC 330 according to an exemplary embodiment includes a regulator 331, a memory 332, a shift register and latch circuit 333, a core logic unit 334, and first and second control switches SW1 and SW2.

The regulator 331 may convert a driving voltage Vd supplied from an external device (e.g., a DC/DC converter) into a working voltage corresponding to a first power domain. Herein, the working voltage may be about 0V to about 1.5V or about 2V.

The memory 332 may store R, G, and B image data provided from an external device. For example, in a mobile electronic device, the memory 332 may receive R, G, and B image data provided from an application processor. The memory 332 may transfer the R, G, and B image data to the shift register and latch circuit 333. The memory 332 may operate using a working voltage corresponding to a first power domain, which is supplied to the memory 332 by the regulator 331. The memory 332 may be, for example, a volatile memory. For example, the memory 332 may be formed of SRAM, DRAM, or SDRAM. However, exemplary embodiments of the memory 332 are not limited thereto.

The shift register and latch circuit 333 may operate using a working voltage supplied from the regulator 331. That is, the shift register and latch circuit 333 may operate based on a working voltage corresponding to the first power domain. The shift register and latch circuit 333 may sequentially shift and store R, G, and B image data transferred from the memory 332 so as to be latched at a latch circuit by the horizontal line. According to exemplary embodiments, the source driver IC 330 may be configured such that R, G, and B image data are transferred to the shift register and latch circuit 333 through the core logic unit 334. However, exemplary embodiments of the inventive concept are not limited thereto.

The first control switch SW1 may control the supplying of the working voltage, which corresponds to the first power domain, to the shift register and latch circuit 333. The first control switch SW1 may be disposed between the regulator 331 and the shift register and latch circuit 333.

The second control switch SW2 may control the supplying of the working voltage, which corresponds to the first power domain, to the memory 332. The second control switch SW2 may be disposed between the regulator 331 and the memory 332.

In exemplary embodiments, each of the first and second control switches SW1 and SW2 may be, for example, a PMOS transistor or an NMOS transistor. However, exemplary embodiments of the inventive concept are not limited thereto.

The core logic unit 334 may receive a working voltage transmitted by the regulator 331, and may operate responsive to a source control signal SDC transmitted by a controller 120 (see, for example, FIG. 1). The core logic unit 334 may determine a mode of operation of the source driver IC 330. The core logic unit 334 may control the first and second control switches SW1 and SW2 according to a mode of operation of the source driver IC 330.

For example, when the source driver IC 330 operates in the display mode, the core logic unit 334 may close the first control switch SW1 using a control signal SW1_con. Further, the core logic unit 334 may close the second control switch SW2 using a control signal SW2_con. When the source driver IC 330 operates in the standby mode, the core logic unit 334 may open the first control switch SW1 using the control signal SW1_con. Further, the core logic unit 334 may open the second control switch SW2 using the control signal SW2_con. The core logic unit 334 may include, for example, a CPU.

In an exemplary embodiment, the core logic unit 334 may control the first and second control switches SW1 and SW2 at the same time, or substantially at the same time. For example, the core logic unit 334 may control the first and second control switches SW1 and SW2 to be closed or opened at the same time, or substantially at the same time.

Alternatively, the core logic unit 334 may control the first and second control switches SW1 and SW2 independently. For example, the core logic unit 334 may control the second control switch SW2 so as to be closed regardless of the mode of operation of the source driver IC 330. A voltage to be supplied to the memory 332 and the shift register and latch circuit 333 operating in the first power domain (e.g., a low voltage domain) may be controlled independently.

As described above, the source driver IC 330 may control a working voltage to be supplied to the shift register and latch circuit 333, which operates in the first power domain (e.g., a low voltage domain), according to a current mode of operation. Further, the supplying of a working voltage to the memory 332, which operates in the first power domain (e.g., a low voltage domain), may be controlled regardless of the current mode of operation of the source driver IC 330. For example, when the source driver IC 330 operates in a standby mode, a working voltage to be supplied to the memory 332 and the shift register and latch circuit 333 may be blocked and may not be supplied to the memory 332 and the shift register and latch circuit 333, which may result in a leakage current of the low voltage domain being reduced.

Figure 7:
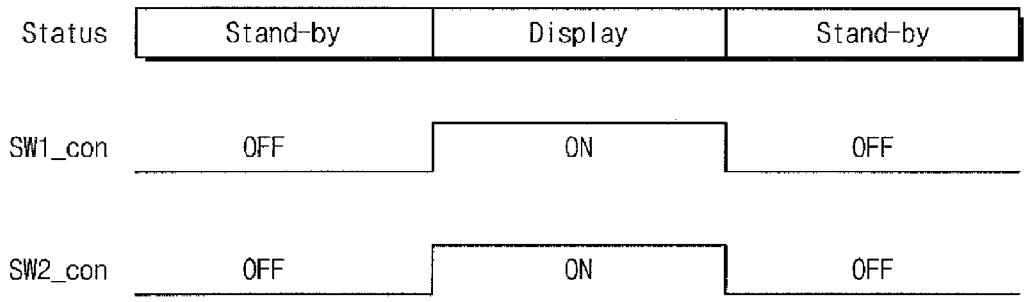
FIGS. 7 and 8 are diagrams illustrating operations of first and second control switches in FIG. 6, according to an exemplary embodiment of the inventive concept.
Figure 8:
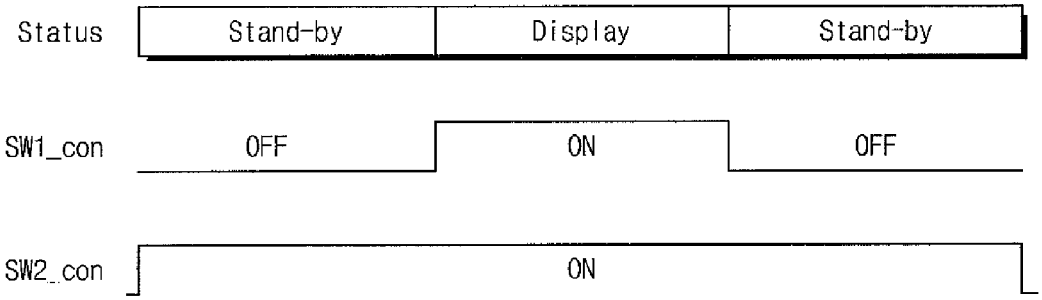

FIGS. 7 and 8 are diagrams illustrating operations of first and second control switches in FIG. 6, according to an exemplary embodiment of the inventive concept.

Referring to FIG. 7, the core logic unit 334 of the source driver IC 330 may provide a first control switch SW1 with a control signal SW1_con for controlling the first control switch SW1 (see, for example, FIG. 6). Further, the core logic unit 334 may provide a second control switch SW2 with a control signal SW2_con for controlling the second control switch SW2 (see, for example, FIG. 6). For example, the core logic unit 334 may determine a mode of operation of the source driver IC 330, and may transmit the control signal SW1_con to the first control switch SW1 and the control signal SW2_con to the second control switch SW2 corresponding to the determined mode of operation, respectively.

For example, as shown in FIG. 7, when the source driver IC 330 operates in a standby mode, the core logic unit 334 may transmit the control signal SW1_con having a low logic level to the first control switch SW1, and the control signal SW2_con having a low logic level to the second control switch SW2. In this case, the control switch SW1 may be opened such that a working voltage to be supplied to the shift register and latch circuit 333 is blocked and is not transmitted to the shift register and latch circuit 333.

When the source driver IC 330 operates in a display mode, the core logic unit 334 may transmit the control signal SW1_con having a high logic level to the first control switch SW1, and the control signal SW2_con having a high logic level to the second control switch SW2. In this case, the first control switch SW1 and the second control switch SW2 may be closed such that a working voltage is supplied to the memory 332 and the shift register and latch circuit 333.

The control signal SW2_con transmitted to the second control switch SW2 may be different from the control signal SW2_con as shown in FIG. 7. For example, in an exemplary embodiment, the core logic unit 334 may always provide the second control switch SW2 with a control signal SW2_con having a high logic level regardless of the mode of operation of the source driver IC 330, as shown in FIG. 8. In this case, a working voltage may be supplied to the memory 332 regardless of the mode of operation of the source driver IC 330.

Figure 9:
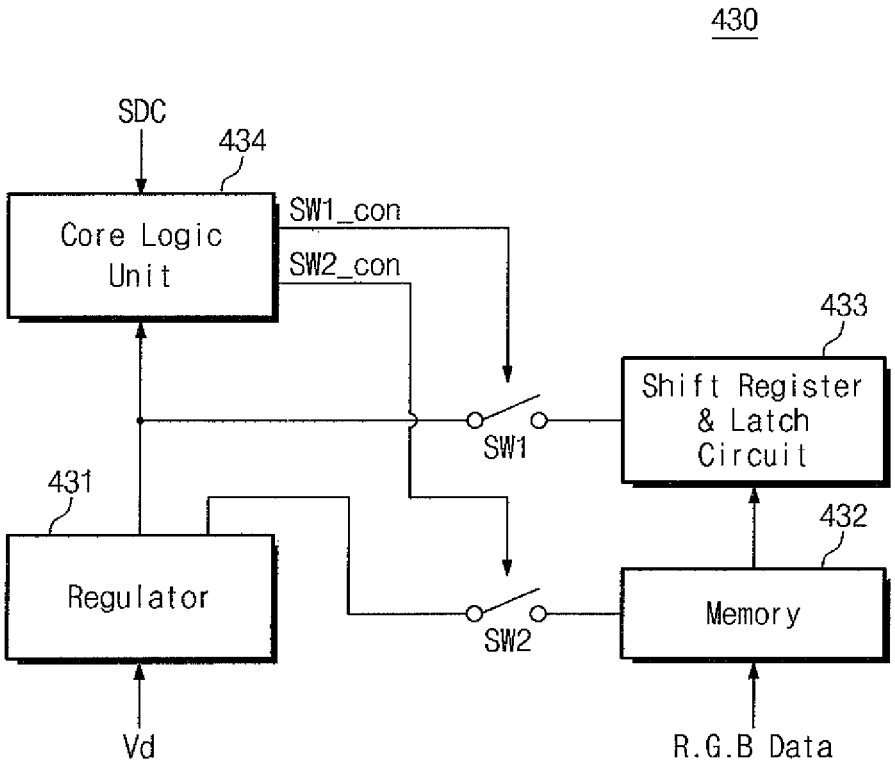
FIG. 9 is a block diagram illustrating a source driver IC, according to an exemplary embodiment of the inventive concept.

FIG. 9 is a block diagram illustrating a source driver IC, according to an exemplary embodiment of the inventive concept.

Referring to FIG. 9, a source driver IC 430 according to an exemplary embodiment includes a regulator 431, a memory 432, a shift register and latch circuit 433, core logic unit 434, and first and second control switches SW1 and SW2.

The regulator 431 may convert a driving voltage Vd supplied from an external device (e.g., a DC/DC converter) into working voltages respectively corresponding to first to third power domains. For example, the regulator 431 may internally generate a plurality of working voltages respectively corresponding to first to third power domains. In FIG. 9, a single regulator 431 capable of generating a plurality of working voltages is shown. According to exemplary embodiments, the source driver IC 430 may include a plurality of regulators, each generating different working voltages respectively corresponding to the first to third power domains. For example, the single regulator 431 may be replaced with a first regulator that generates a working voltage corresponding to the first power domain, a second regulator that generates a working voltage corresponding to the second power domain, and a third regulator that generates a working voltage corresponding to the third power domain.

The memory 432 and the shift register and latch circuit 433 may operate in different power domains. For example, the memory 432 and the shift register and latch circuit 433 may operate using working voltages corresponding to different power domains. In exemplary embodiments, the memory 432 may operate using a working voltage corresponding to the first power domain, and the shift register and latch circuit 433 may operate using a working voltage corresponding to the second power domain. Alternatively, the memory 432 may operate using a working voltage corresponding to the second power domain, and the shift register and latch circuit 433 may operate using a working voltage corresponding to the first power domain.

In this case, the first control switch SW1 may control a working voltage corresponding to the second power domain to be supplied to the shift register and latch circuit 433. The second control switch SW2 may control a working voltage corresponding to the first power domain to be supplied to the memory 432.

The core logic unit 434 may determine a mode of operation of the source driver IC 430. The core logic unit 434 may control the first and second control switches SW1 and SW2 according to a mode of operation of the source driver IC 430. For example, when the source driver IC 430 operates in the display mode, the core logic unit 434 may close the first control switch SW1 using a control signal SW1_con. Further, the core logic unit 434 may close the second control switch SW2 using a control signal SW2_con. When the source driver IC 430 operates in the standby mode, the core logic unit 434 may open the first control switch SW1 using the control signal SW1_con. Further, the core logic unit 434 may open the second control switch SW2 using the control signal SW2_con.

In an exemplary embodiment, the core logic unit 434 may control the first and second control switches SW1 and SW2 at the same time, or substantially at the same time. For example, the core logic unit 434 may control the first and second control switches SW1 and SW2 to be closed or opened at the same time, or substantially at the same time.

Alternatively, the core logic unit 434 may control the first and second control switches SW1 and SW2 independently. For example, the core logic unit 434 may control the second control switch SW2 so as to be closed regardless of the mode of operation of the source driver IC 430. A voltage to be supplied to the memory 432 and the shift register and latch circuit 433 operating in different power domains may be controlled independently.

Figure 10:
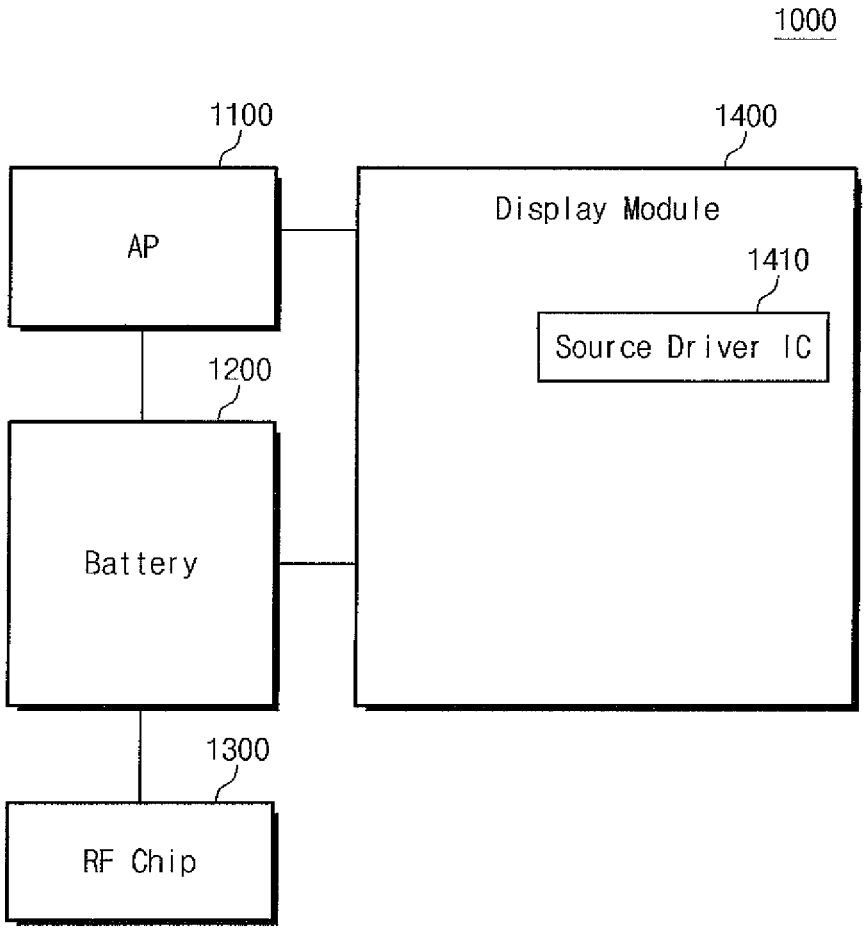
FIG. 10 is a block diagram illustrating an electronic device including a source driver IC, according to an exemplary embodiment of the inventive concept.

FIG. 10 is a block diagram illustrating an electronic device including a source driver IC according to an exemplary embodiment of the inventive concept. FIG. 10 illustrates a source driver IC being utilized in a mobile communication electronic device. However, exemplary embodiments of the inventive concept are not limited thereto. For example, the electronic device may be any type of electronic device communicating with an external device including a display device.

Referring to FIG. 10, an electronic device 1000 according to an exemplary embodiment of the inventive concept includes an application processor 1100, a battery 1200, an RF chip 1300, and a display module 1400.

The application processor 1100 may be powered by the battery 1200, and may control an overall operation of the electronic device 1000. For example, the application processor 1100 may control an operation of the display module 1400. When the electronic device 1000 is turned on, the application processor 1100 may set an operating mode of the display module 1400 to a display mode. When the electronic device 1000 is turned off, the application processor 1100 may set an operating mode of the display module 1400 to a standby mode. Herein, turning on the electronic device 1000 refers to converting the operating mode of the electronic device 1000 from standby mode to display mode (e.g., driving mode), and turning off the electronic device 1000 refers to converting the operating mode of the electronic device 1000 from display mode (e.g., driving mode) to standby mode.

The RF chip 1300 may transmit and receive data to and from an external device.

The display module 1400 may be controlled by the application processor 1100, and may output R, G, and B image data. The display module 1400 may include a source driver IC 1410. The source driver IC 1410 may generate voltages corresponding to the R, G, and B image data and may supply them to a display panel. This operation of the source driver IC 1410 may be understood to be an operation of a display mode. Alternatively, when the source driver IC 1410 is in a standby state without performing the above-described operation, it may be understood to be an operation of a standby mode.

While the present inventive concept has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A display driver integrated circuit, comprising:

a regulator configured to convert an externally supplied driving voltage to a working voltage corresponding to one of a plurality of power domains of the display driver integrated circuit;

a graphic data processing unit configured to process image data input to the graphic data processing unit, and output the image data to a display panel;

a first control switch configured to control a supply of the working voltage to the graphic data processing unit;

a core logic unit configured to receive the working voltage from the regulator and control the first control switch in response to a mode of operation of the display driver integrated circuit;

a memory configured to store the image data; and a second control switch configured to control a supply of the working voltage to the memory, wherein the graphic data processing unit comprises:

a shift register configured to sequentially shift and store the image data, and output the image data; and a latch circuit configured to latch the image data output from the shift register.

2. The display driver integrated circuit of claim 1, wherein the first control switch is closed and the working voltage is supplied to the graphic data processing unit while the mode of operation is a display mode.

3. The display driver integrated circuit of claim 1, wherein the first control switch is opened and the working voltage is not supplied to the graphic data processing unit while the mode of operation is a standby mode.

4. The display driver integrated circuit of claim 1, wherein the shift register and the latch circuit operate in a first power domain from among the plurality of power domains, and the first power domain has a lowest voltage of the plurality of power domains.

5. The display driver integrated circuit of claim 4, wherein the graphic data processing unit further comprises:

a digital-to-analog (D/A) converter configured to receive the image data from the latch circuit and generate a voltage for outputting the image data to the display panel.

6. The display driver integrated circuit of claim 5, wherein the D/A converter operates in a second power domain using a voltage higher than the lowest voltage used in the first power domain.

7. The display driver integrated circuit of claim 1, wherein the memory operates in a first power domain from among the plurality of power domains, and the first power domain has a lowest voltage of the plurality of power domains.

8. The display driver integrated circuit of claim 1, wherein the first control switch is opened and the working voltage is not supplied to the shift register and the latch circuit while the mode of operation is a standby mode.

9. The display driver integrated circuit of claim 1, wherein the core logic unit is configured to control the second control switch, and the second control switch is closed regardless of the mode of operation of the display driver integrated circuit.

10. The display driver integrated circuit of claim 1, wherein the memory is a volatile memory.

11. An electronic device, comprising:

a display module configured to output image data via a display panel;

a processor configured to control the display module; and a battery configured to supply power to the processor and the display module, wherein the display module comprises a source driver integrated circuit configured to process the image data and output the image data to the display panel, the source driver integrated circuit blocks a supply of a voltage used to process the image data while the display module operates in a standby mode, and the image data is not output to the display panel while in the standby mode, and wherein the source driver integrated circuit comprises a graphic data processing unit configured to process the image data and output the image data to the display panel, a first control switch configured to control the supply of the voltage used to process the image data to the graphic data processing unit, and a core logic unit configured to control the first control switch;

a memory configured to store the image data; and a second control switch configured to control a supply of the voltage to the memory, wherein the graphic data processing unit comprises a shift register configured to sequentially shift and store the image data and output the image data, and a latch circuit configured to latch the image data output from the shift register.

12. The electronic device of claim 11, wherein the core logic unit closes the first control switch and the voltage is supplied to the graphic data processing unit while the display module operates in a display mode, wherein the image data is output to the display panel while in the display mode.

13. A method of driving a display device, comprising:

converting an externally supplied driving voltage to a working voltage corresponding to one of a plurality of power domains of a display driver integrated circuit;

processing image data in a graphic data processing unit of the display driver integrated circuit;

controlling a supply of the working voltage to the graphic data processing unit using a first control switch;

storing the image data in a memory;

controlling a supply of the working voltage to the memory using a second control switch;

sequentially shifting and storing the image data, and outputting the image data, by a shift register disposed in the graphic data processing unit; and latching the image data output from the shift register by a latch circuit disposed in the graphic data processing unit, wherein the working voltage is supplied to the graphic data processing unit or blocked from the graphic data processing unit based on a mode of operation of the display driver integrated circuit.

14. The method of claim 13, further comprising:

closing the first control switch operatively coupled to the graphic data processing unit while the mode of operation is a display mode, wherein the working voltage is supplied to the graphic data processing unit in the display mode.

15. The method of claim 13 further comprising:

opening the first control switch operatively coupled to the graphic data processing unit while the mode of operation is a standby mode, wherein the working voltage is blocked from the graphic data processing unit in the standby mode.

16. The method of claim 13, wherein the shift register and the latch circuit operate in a first power domain from among the plurality of power domains, and the first power domain has a lowest voltage of the plurality of power domains.

17. The method of claim 16, wherein the graphic data processing unit further comprises a digital-to-analog (D/A) converter receiving the image data from the latch circuit and generating a voltage for outputting the image data to a display panel, wherein the D/A converter operates in a second power domain using a voltage higher than the lowest voltage used in the first power domain.

* * * * *